US010588367B2

(12) United States Patent
Alekseev

(10) Patent No.: US 10,588,367 B2
(45) Date of Patent: Mar. 17, 2020

(54) ROPE BELT WITH A BUCKLE HAVING HOLES

(71) Applicant: Andrei Nikolayevich Alekseev, St. Petersburg (RU)

(72) Inventor: Andrei Nikolayevich Alekseev, St. Petersburg (RU)

( * ) Notice: Subject to any disclaimer, the term of this patent is extended or adjusted under 35 U.S.C. 154(b) by 118 days.

(21) Appl. No.: 15/877,858

(22) Filed: Jan. 23, 2018

(65) Prior Publication Data

US 2019/0223531 A1 Jul. 25, 2019

(51) Int. Cl.
*A41F 9/02* (2006.01)
*A41F 9/00* (2006.01)

(52) U.S. Cl.
CPC ..... *A41F 9/025* (2013.01); *A41F 9/002* (2013.01)

(58) Field of Classification Search
CPC .. A41F 9/025; A41F 9/002; A41F 9/02; A41F 9/00; A44B 11/04
USPC ..... 63/23, 38, 3, 40; 2/319, 321, 322; 403/314; 24/265 R, 265 BC, 265 AL, 910
See application file for complete search history.

(56) References Cited

U.S. PATENT DOCUMENTS

| | | | | |
|---|---|---|---|---|
| 1,106,658 | A | 8/1914 | Luckwell | |
| 2,781,062 | A | 2/1957 | White | |
| 3,371,351 | A | 3/1968 | Allain | |
| D353,174 | S | 12/1994 | Peach | |
| 6,134,713 | A | 10/2000 | De Rosa et al. | |
| 6,275,994 | B1 | 8/2001 | Lewis et al. | |
| 2004/0034972 | A1 * | 2/2004 | Brown | B63B 21/08 24/129 R |
| 2008/0245610 | A1 | 10/2008 | Lee | |
| 2009/0120270 | A1 | 5/2009 | Welch et al. | |

FOREIGN PATENT DOCUMENTS

| | | | | |
|---|---|---|---|---|
| EP | 0648876 | | 4/1995 | |
| GB | 191313331 | A * | 11/1913 | A41F 9/002 |
| WO | 9426963 | | 11/1994 | |
| WO | 9958008 | | 11/1999 | |
| WO | 2007032626 | | 3/2007 | |

* cited by examiner

*Primary Examiner* — Jack W Lavinder
(74) *Attorney, Agent, or Firm* — Gearhart Law, LLC

(57) ABSTRACT

A rope belt for securing a garment on the body of a wearer and optionally, for providing a utility to the wearer of always having a rope and buckle for various applications, may have a buckle having a plurality of holes for receiving a rope, and at least one rope having, at least, a first end of the rope passing through at least one of the plurality of holes on the buckle and further forming loop for hooking onto the buckle.

16 Claims, 7 Drawing Sheets

ROPE BELT WITH A BUCKLE HAVING HOLES

CLAIM OF PRIORITY

This application is a United States non-provisional application and claims no priority to any previous patent or patent application.

FIELD OF THE EMBODIMENTS

The embodiments of the present invention relate to a rope belt for securing a garment, such as a pair of trousers or other clothing articles, on the body of a wearer and optionally, for providing a utility to the wearer of always having a rope and buckle for various applications.

BACKGROUND OF THE EMBODIMENTS

A large variety of belts of different designs are available on the market to secure trousers and other articles of clothing firmly on a wearer's body, ranging from the very simple to the highly decorative and intricate. For instance, there are belts made simply of a length of fabric that can be tied around the waist of a wearer, such as bath robe ties, while at the other extreme, there are very decorative belts. Such belts may be made of rare leather and furnished with an elaborate buckle, or are designed to encircle the waist of a user multiple times before being secured. The list goes on, but there continue to be other needs of the people that are unmet.

Examples of related art are described below:

U.S. Pat. No. 3,371,351A relates to a belt comprising two sections with a rope of substantial length connecting the ends of the two sections around the back of the body to provide a storage for an extended length of rope which may be detached for some additional usage. The two sections are detachably connected in the front in any conventional manner. It is noted that rope(s) only involved in half of the belt with the remainder of a normal leather belt.

U.S. 2009/0120270A1 relates to a braided water resistant flexible strong plastic rope and method of making, comprising a first, second and third braided strand of three flexible ribbons of connected plastic bags operable to sustain substantial tensile forces. When the central, left and right braided strands are braided together they form a braided water resistant flexible strong plastic rope. The rope can be used for braided belts and handles. It is noted that there is no buckle involved in forming the belt.

U.S. 2008/0245610A1 relates to a personal emergency rescue/security belt (PERB). The PERB can be put on rapidly and easily, and the cost is lower and is more light-weight, and provides multi-purposes. The PERB is changeable into emergency life-saying equipment to carry a person on a rescuer's back, under a rescuer's arm, or on a stretcher. Particularly, in the case of an emergency, the injured person is rapidly escorted from the accidental disaster, or he may escape by means of putting the PERB on by himself to reach safety. It is noted that this is not a rope belt at all.

U.S. Pat. No. 6,134,713A relates to a garment, such as a coat, shirt, or jacket, for a firefighter, a rescue worker, a forestry worker, or another worker having to carry a rope has a back portion and two front portions, each front portion extending from the back portion at one side of the garment. A back pocket extending at least substantially across the backs portion, between the sides of the garment, is adapted to carry a rope placed in a zigzag pattern. A front pocket extending at least partially across one of the front portions of the garment communicates with the back pocket, through a slit in the garment, so that a rope carried within the back pocket is removable through the slit and through the front pocket. A front flap overlies the front pocket and the slit. It is noted that this is not a belt, but rather ropes contained in concealed pocket on the garment.

None of the art described above addresses all of the issues that the embodiments of the present invention address. The present invention and its embodiments describe to a garment belt made of a rope that is attached to a specially designed buckle having holes, through which holes the rope threads. The buckle can be held by friction at a particular position on the rope to enable the adjustment of the length of the rope belt. In addition, the present invention and its embodiments relate to a utility for the wearer of the rope belt for always having around the wearer a strong rope and a buckle, which is made, optionally, of heavy metal for personal protection, survival and other everyday use purposes. Suitable areas of uses of the rope belt of the present invention and its embodiments include, but are not limited to, daily household use, fashion-oriented wearing, military, travel/tourism (hiking, backpacking, climbing) and emergency personnel (firefighters, EMS, police, SWAT units, coast guard, forest service).

SUMMARY OF THE EMBODIMENTS

In one of the embodiments, the present invention provides a rope belt that comprises a buckle having a plurality of holes for receiving a rope and at least one rope having, at least, a first end of the rope passing through at least first one of the plurality of holes on the buckle and further forming a loop for hooking onto the buckle. Here, the rope frictionably engages at least one of the plurality of holes such that the buckle can be held at a position of the rope to enable the adjustment of a length of the rope belt.

In accordance with one aspect of the present invention, the holes on the buckle in the buckle can be of any shape, form or size and have appropriate sizes and shapes to accommodate the rope. Furthermore, the holes can either be untreated and/or altered, or have a bevel from 1 degree to 89 degrees, be deburred.

In accordance with one aspect of the present invention, the loop is disposed on a second end of the rope and is formed by folding and affixing the second end of the rope back onto a mid-section of the rope.

In accordance with another aspect of the present invention, the loop is formed by also threading the second end of the rope into at least second one of the plurality of holes on the buckle.

In another of the embodiments, the present invention provides a rope belt that comprises a buckle having a plurality of holes wherein the buckle comprises from 2 to 16 holes.

In one of the embodiments, the present invention provides a rope belt that comprises a buckle having a plurality of holes wherein the holes are arranged in various configurations used for various threading patterns.

In accordance with another aspect of the present invention, the plurality of ropes are bunched or joined together passing through the plurality of holes on the buckle and forming one loop.

In accordance with yet another aspect of the present invention, the plurality of ropes act independently by passing through independent plurality of holes on the buckle and forming independent loops that can be bunched into one loop.

In yet another of the embodiments, the present invention provides a rope belt that comprises a buckle having a plurality of holes arranged in at least two rows for receiving at least two of a plurality of ropes, a first rope having a first end passing through a first row of the plurality of holes and a second end passing through a second row of the plurality of holes, thus forming a loop for hooking onto the buckle, and a second rope having a fast end passing through a third row of the plurality of holes and a second end passing through a fourth row of the plurality of holes, thus also forming a loop for hooking onto the buckle, wherein each of the two ropes frictionably engages in at least two rows of the plurality of holes such that they can concertedly hold the buckle at any position on the rope to enable the adjustment of a length of the rope belt.

In accordance with yet another aspect of the present invention, the holes in the buckle can be of any shape, form or size and have sizes and shapes to accommodate the at least one rope.

In accordance with still another aspect of the present invention, the aforementioned holes can either be untreated and/or altered, or have a bevel from 1 degree to 89 degrees, be deburred. Furthermore, the holes in the buckle can be of any shape, form or size.

In accordance with still another aspect of the present invention, the buckle comprises from 2 to 16 holes on said buckle.

In accordance with still another aspect of the present invention, the buckle comprises holes on said buckle arranged in at least two rows.

In yet another of the embodiments, the present invention provides a method of forming at least one rope belt and using the rope belt to secure a garment at a desired body position of a user, said method comprising the steps of passing, a first end of a first rope through a plurality of holes on a buckle, wherein said plurality of holes are arranged in at least two rows for receiving the first end and a second end of the at least one rope; wrapping the second end of the at least one rope back onto a mid-section of the at least one rope to form a loop; adjusting a length of the rope belt by moving the buckle to a position on the at least one rope, wherein the buckle is held at the position via a friction fit between the at least one rope and the plurality of holes on the buckle; and hooking the loop of the at least one rope around the buckle to secure the belt.

In yet another of the embodiments, the present invention provides yet another method of forming a rope belt with at least one rope, and using the rope belt to secure a garment on a desired body position of a user, and said method comprising the steps of passing the second end of the at least one rope through a second row of the at least two rows of holes on the buckle.

In an emergency, a rope belt for trousers or garments can become the best source article available to derive a length of survival line from. In fact, most outdoorsmen use a belt, or at least would not regard it as burdensome to carry with them, even on the longest treks to the most remote locations. Therefore, in emergency situations, the rope belt will be immediately and readily available for conversion into a length of survival line.

Accordingly, it is an object of the embodiments of the present invention to provide rope belt for wearing either to fasten a garment, such as a pair of trousers, to the wearer's body, and at the same time it can serve as an article having a utility of its own where the article is convenient for the wearer to always carry with him/her and can be quickly unlocked from the buckle to be converted into a survival line or an object for personal protection and other daily household uses.

DESCRIPTION OF THE PREFERRED EMBODIMENTS

Figure 1A:
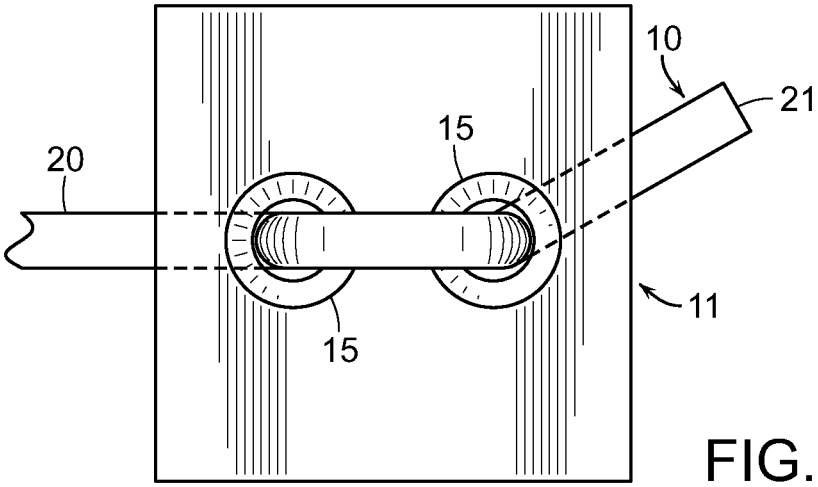
FIG. 1A shows a front view of one of the embodiments of the invention of the buckle.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIG. 1A, one of the embodiments of the present invention provides an end section of a rope belt 10 as having a buckle 11 on the mid-section of which there are two holes that are aligned as a straight line for receiving a rope 20. Here, the rope 20 frictionably engages in the two holes 15 such that the buckle 11 can be held at any position of the rope so as to enable the adjustment of a suitable length of the rope belt. It is believed that the friction is associated with the bending and threading the belt through the adjacent holes. The holes 15 on the buckle 11 have proper sizes to receive the rope 20, as well as, in some embodiments, beveled edges on both a front surface side and/or a rear surface side of the buckle 11 (see FIG. 5) to increase the contact of the rope 20 with the holes on the buckle 11, thus enhancing their engagement by friction.

Figure 1B:
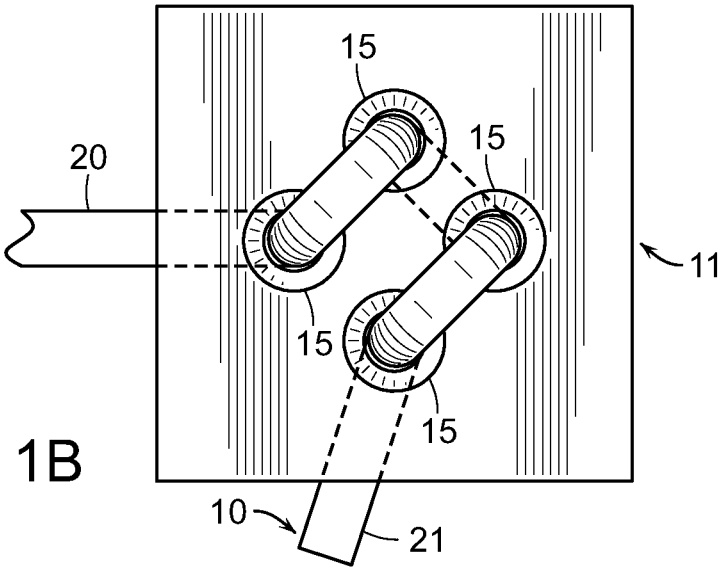
FIG. 1B shows a front view of another embodiment of the invention of the buckle.

Referring now to FIG. 1B, another embodiment of the present invention provides an end section of a rope belt 10 as having a buckle 11 on which there are four holes 15 that are arranged in a diamond pattern for receiving a rope 20. Here, the rope 20 frictionably engages in the four holes 15 (as shown) such that the buckle 11 can be held at any position of the rope 20 so as to enable the adjustment of a suitable length of the rope belt 10. It is believed that the friction is associated with the bending and threading the belt through the adjacent holes. The holes 15 on the buckle 11 have proper sizes to receive the rope 20, as well as, in some embodiments, beveled edges on both a front surface side and/or a rear surface side of the buckle 11 (see FIG. 5) to increase the contact of the rope 20 with the holes 15 on the buckle 11, thus enhancing their engagement by friction.

Figure 1C:
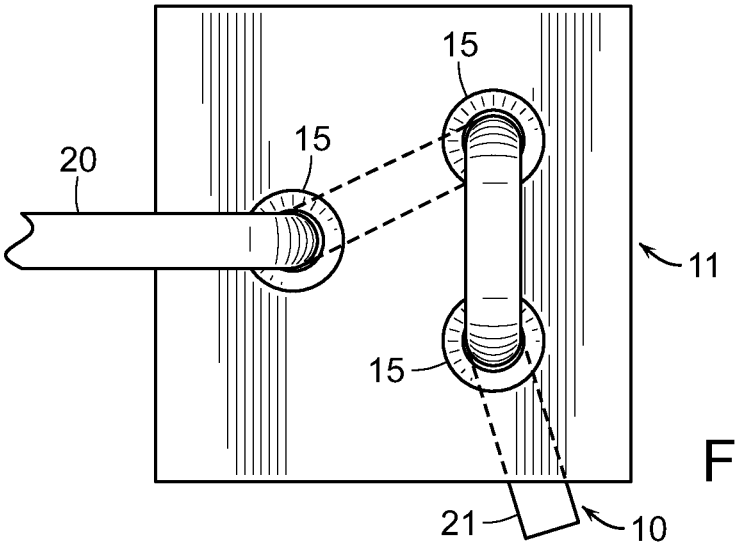
FIG. 1C shows a front view of yet another embodiment of the invention of the buckle.

Referring now to FIG. 1C, yet another embodiment of the present invention provides an end section of a rope belt 10 as having a buckle 11 on which there are three holes 15 that are arranged in a triangle pattern for receiving a rope 20. Here, the rope 20 frictionably engages in the three holes 15 (as shown) such that the buckle 11 can be held at any position of the rope 20 so as to enable the adjustment of a suitable length of the rope belt 10. It is believed that the friction is associated with the bending and threading the belt through the adjacent holes. The holes 15 on the buckle have proper sizes to receive the rope 20 and, in some embodiments, beveled edges on both a front surface side and/or a rear surface side of the buckle 11 (see FIG. 5) to increase the contact of the rope 20 with the holes 15 on the buckle 11, thus enhancing their engagement by friction.

Figure 2A:
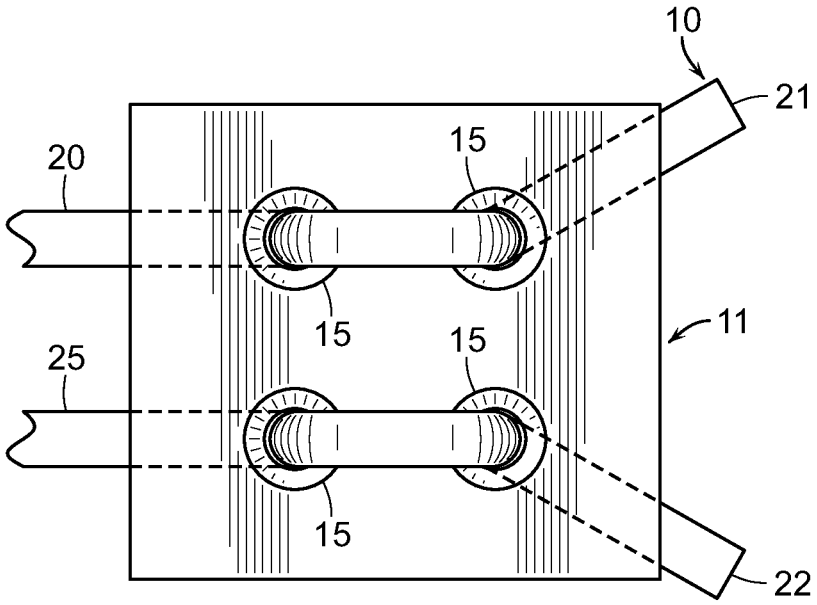
FIG. 2A shows a front view of yet another embodiment of the invention of the buckle.

Referring now to FIG. 2A, still another embodiment of the present invention provides an end section (as shown) of a rope belt 10 as having a buckle 11 on which there are four holes 15 that are aligned as two rows of straight lines (each line comprises two holes) for receiving first rope 20 and second rope 25. Through one of the two rows of holes 15 on the buckle 11 is threading the first rope 20 at or near its first end 21 and through another of the two rows of holes 15 on the buckle 11 is threading the second rope 25 at or near its first end 22. Here, the first rope 20 and second rope 25 frictionably engage in the two rows of holes 15 such that the buckle 11 can be held at any position of each of the two ropes 20 and 25 so as to enable the adjustment of a suitable length of the rope belt 10. It is believed that the friction is associated with the bending and threading the belt through the adjacent holes. The holes 15 on the buckle 11 have proper sizes to receive the first rope 20 and second rope 25, as well as, in some embodiments, beveled edges on both a front surface side and/or a rear surface side of the buckle 11 (see FIG. 5) to increase the contact of the first rope 20 and second rope 25 with the holes 15 on the buckle 11, thus enhancing their engagement by friction. Alternatively, the aforementioned first rope 20 and second rope 25 here can be two ends of a single rope.

Figure 2B:
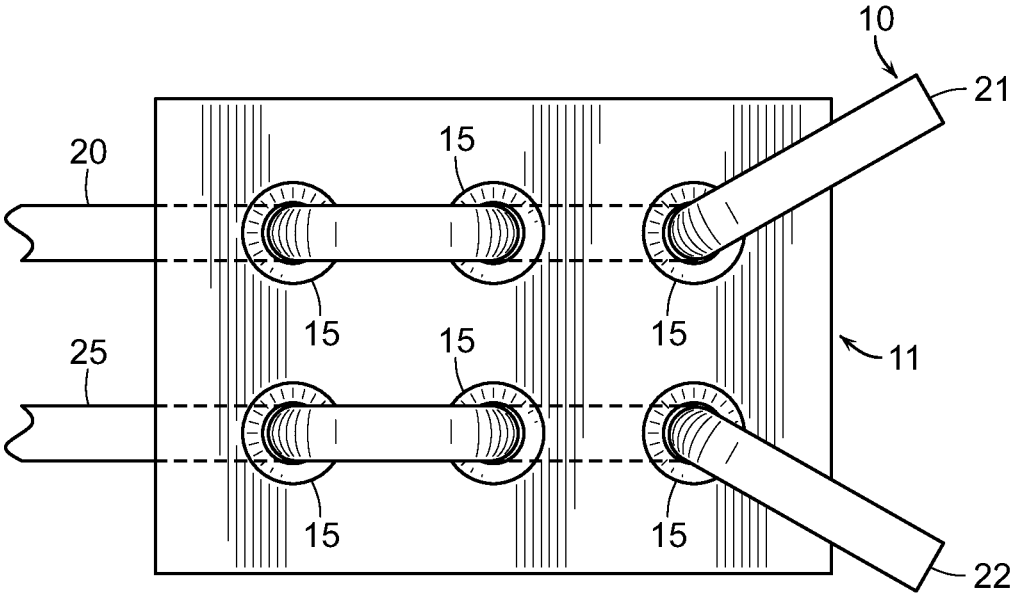
FIG. 2B shows a front view of yet another embodiment of the invention of the buckle.

Referring now to FIG. 2B, yet still another embodiment of the present invention provides an end section (as shown) of a rope belt 10 as having a buckle 11 on which there are six holes 15 that are aligned as two rows of straight lines (each line comprises three holes) for receiving the first ropes 20 and second rope 25. Here, the ropes 20 and 25 frictionably engage in the two rows of holes 15 such that the buckle 11 can be held at any position of each of the first and second ropes (20 and 25) so as to enable the adjustment of a suitable length of the rope belt 10. It is believed that the friction is associated with the bending and threading the belt through the adjacent holes. The holes 15 on the buckle 11 have proper sizes to receive the first and second ropes (20 and 25), as well as, in some embodiments, beveled edges on both a front surface side and/or a rear surface side of the buckle 11 (see FIG. 5) to increase the contact of the ropes 20 and 25 with the holes on the buckle 11, thus enhancing their engagement by friction. Alternatively, the aforemementioned first rope 20 and second rope 25 here can be the two ends of a single rope.

Figure 2C:
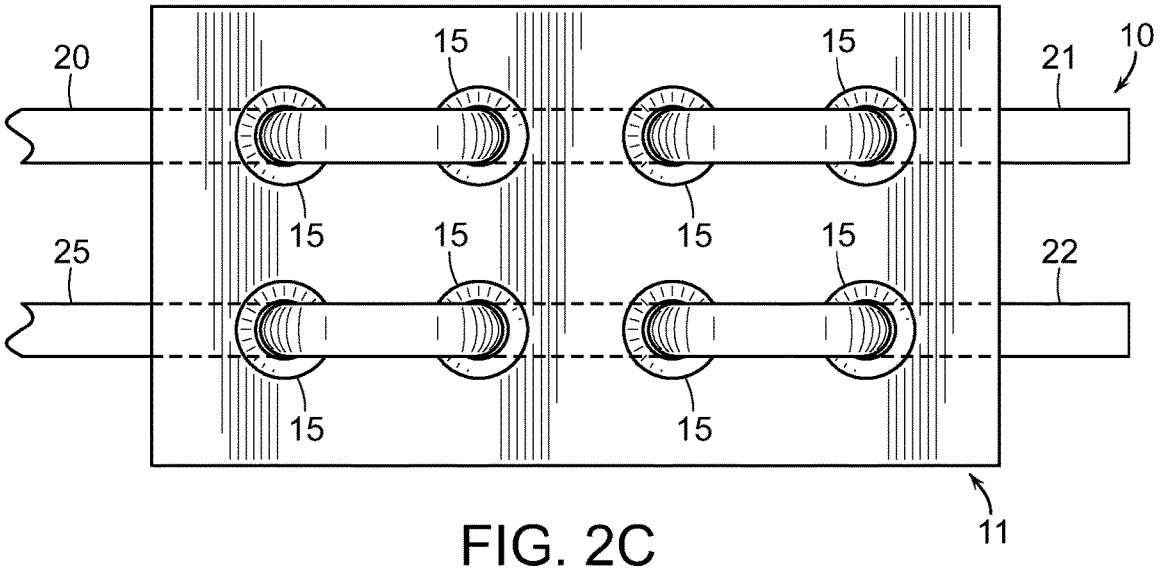
FIG. 2C shows a front view of yet another embodiment of the invention of the buckle.

Referring now to FIG. 2C, yet still another embodiment of the present invention provides an end section (as shown) of a rope belt 10 as having a buckle 11 on which there are eight holes 15 that are aligned as two rows of straight lines (each line comprises four holes) for receiving the first rope 20 and second rope 25. Through one of the two rows of holes 15 on the buckle 11 is threading the first rope 20 at or near its first end 21 and through another of the two rows of holes on the buckle 11 is threading the second rope 25 at or near its first end 22. Here, the first rope 20 and second rope 25 frictionably engage in the two rows of holes 15 such that the buckle 11 can be held at any position of each of the first rope 20 and second rope 25 so as to enable the adjustment of a suitable length of the rope belt 10. It is believed that the friction is associated with the bending and threading the belt through the adjacent holes. The holes 15 on the buckle 11 have proper sizes to receive the ropes 20 and 25, as well as, in some embodiments, beveled edges on both a front surface side and/or a rear surface side of the buckle 11 (see FIG. 5) to increase the contact of the ropes 20 and 25 with the holes on the buckle 11, thus enhancing their engagement by friction. Alternatively, the aforementioned first rope 20 and second rope 25 here can be the two ends of a single rope.

Figure 3:
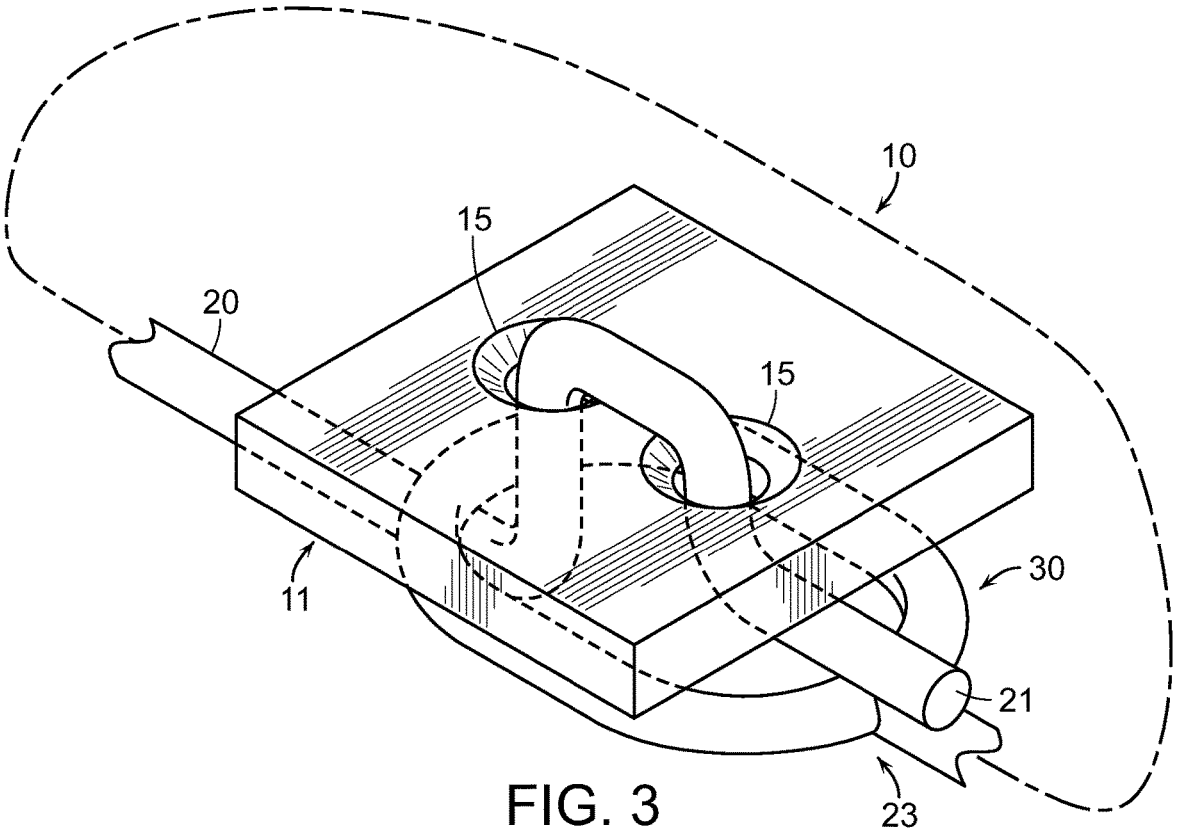
FIG. 3 shows a perspective view of an embodiment of the invention of the rope belt using one of the embodiments of the buckle configuration as shown in FIG. 1A.

Referring now to drawing FIG. 3, yet still another embodiment of the present invention provides a complete configuration of both end sections of a rope belt 10 having a buckle 11 and as such, the first (buckle) end section of the rope belt 10 is configured as described above in details for FIG. 1A. There is a loop 30 disposed on a second end of the rope 20 for hooking the second end section of the rope belt 10 onto buckle 11. The loop 30 is formed by, in some embodiments, folding and affixing the second end 23 of the rope 20 back onto a mid-section of the rope 20.

Yet still another embodiment of the present invention provides a method of forming a rope belt 10 as shown in FIG. 3 for using the rope belt 10 to secure a garment at a desired body position of a user. This method comprises the following steps: i) passing a first end 21 of rope 20 through the two holes 15 on buckle 11 arranged in a row configuration to receive rope 20; ii) wrapping a second end 23 of rope 20 back onto a mid-section of the rope 20 to form a loop 30, thus forming rope belt 10; iii) adjusting a length of rope belt 10 by moving the buckle 11 to a position on rope 20, wherein the buckle 11 is held at the position frictionably between rope 20 and the holes 15; and iv) hooking the loop 30 of rope 20 around the buckle 11 to secure the rope belt 10 onto the wearer.

Figure 4:
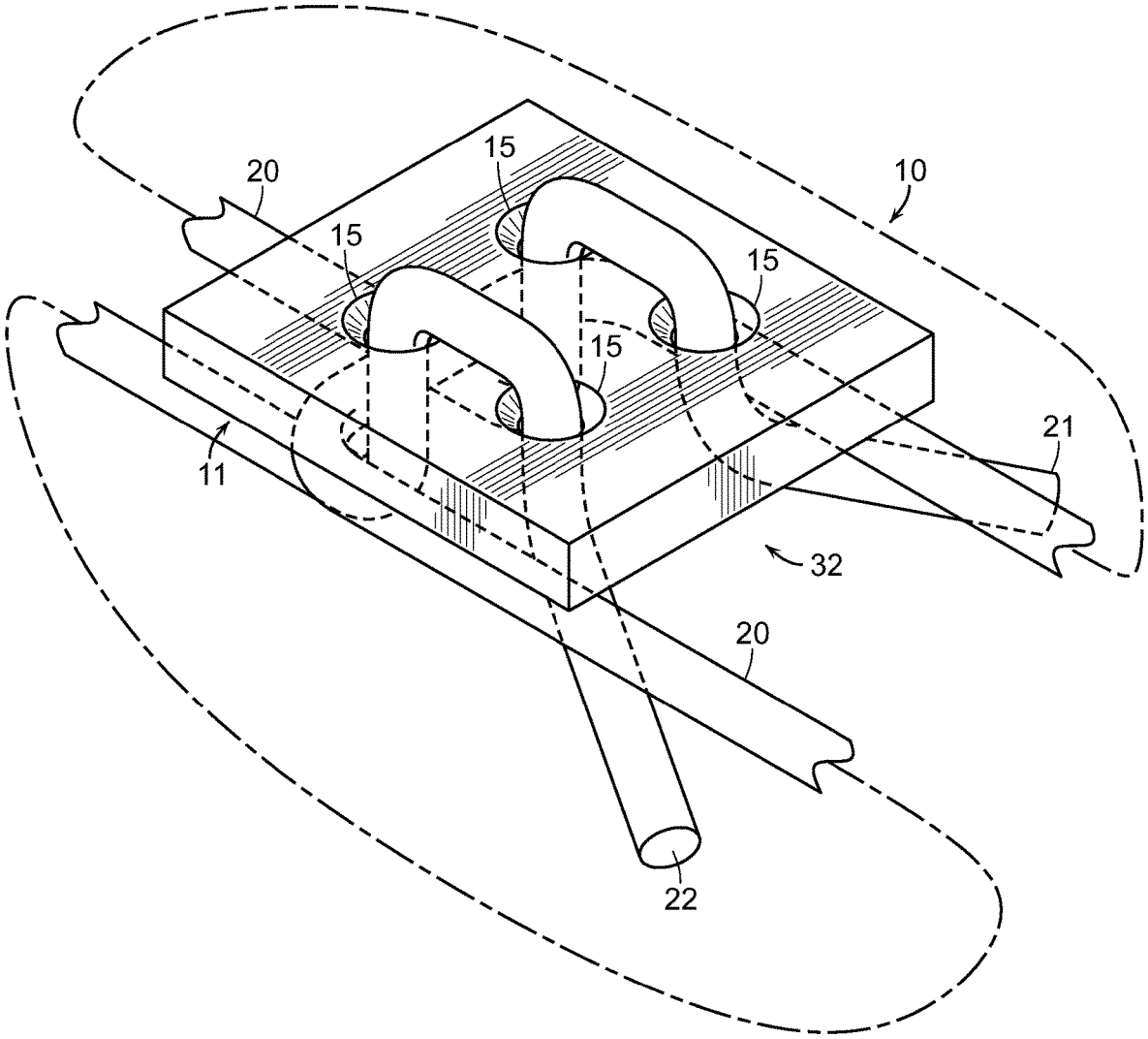
FIG. 4 shows a perspective view of an embodiment of the invention of the rope belt using one of the embodiments of the buckle configuration as shown in FIG. 2A.

Retelling now to drawing FIG. 4, yet still another embodiment of the present invention provides a complete configuration of both end sections of a rope belt 40 comprising one rope 20 and a buckle 11. As such, the first (buckle) end section of the rope belt 40 is configured as described above in details for FIG. 2A. There is a loop 32 formed by also threading the second end 22 of rope 20 in the place of rope 25 in the configuration as shown in FIG. 2A, i.e., threading the second end 22 of rope 20 into second row of the holes 15 on buckle 11. The loop 32 is for hooking onto buckle 11 to complete the configuration of rope belt 40.

Yet still another embodiment of the present invention provides a method of forming a rope belt 40 with one or more ropes, such as two ropes: rope 20 and rope 25, and using the rope belt 40 to secure a garment on a desired body position of a user. The method described below is for forming rope belt 40 with one rope 20 as describe in FIG. 4. The method comprises the following steps: i) passing a first end 21 of rope 20 through a first row of holes 15 on buckle 11, where there are tour holes 15 arranged in two rows for receiving both ends (21 and 22) of rope 20, wherein the buckle 11 is held at the position frictionably between the two ends of rope 20 and holes 15; ii) passing a second end 22 of rope 20 through second row of holes 15 on buckle 11; iii) adjusting a proper length of the rope belt 40 thus formed by proving the buckle 11 to a proper position on rope 20, and iv) hooking the loop 32 of rope 20 thus formed around the buckle 11 to secure.

Referring now to drawing FIG. 5, which is a cross sectional view, yet still another embodiment of the present invention provides the buckle 11 with the holes 15 going through the buckle 11 and having beveled edges on both a front surface side 17 and a rear surface side 19 of the buckle 11.

Figure 6:
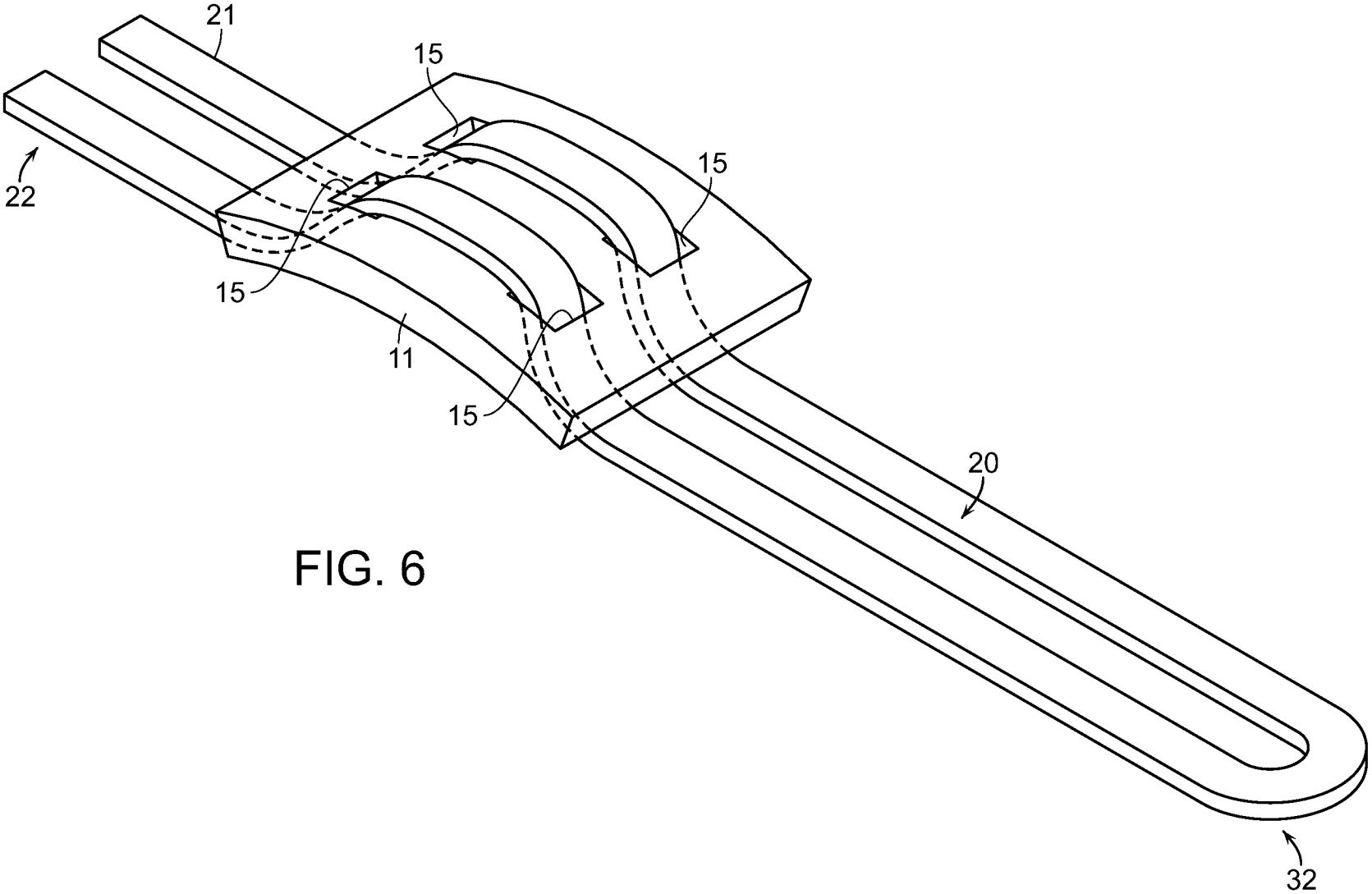
FIG. 6 shows a perspective view of another embodiment of the invention of the rope belt using one of the embodiments of the buckle configuration.

Referring now to drawing FIG. 6, yet still another embodiment of the present invention provides a complete configuration of one end sections of a rope belt 40 comprising one non-standard rope 20 (with a square or rectangular cross section) and a buckle 11 with the matching non-standard holes. As such, there is a loop 32 formed by also threading the second end 22 of rope 20 into the second row of the holes 15 on buckle 11. The loop 32 is for hooking onto buckle 11 to complete the configuration of rope belt 40.

Figure 7:
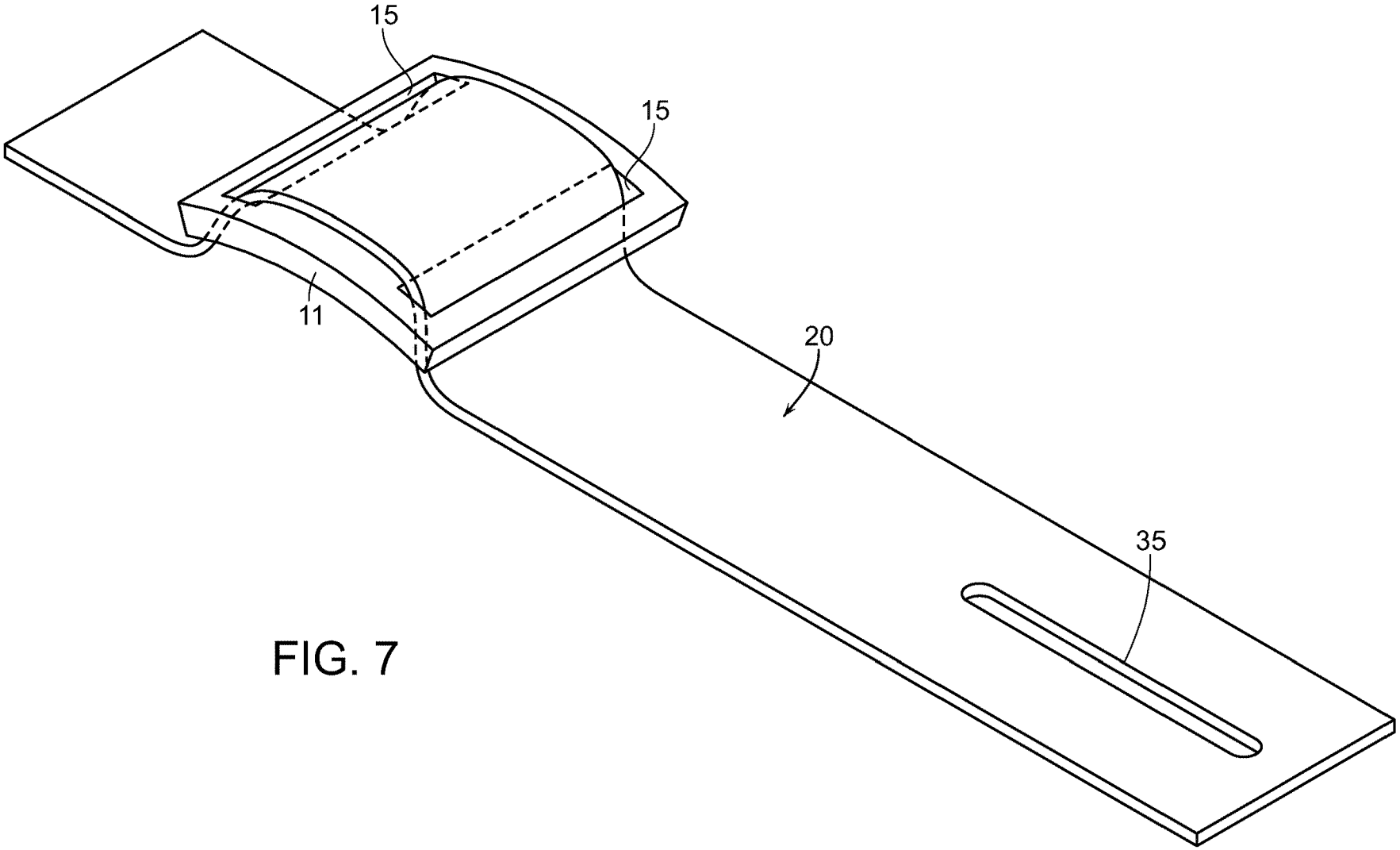
FIG. 7 shows a perspective view of yet another embodiment of the invention of the rope belt using one of the embodiments of the buckle configuration.

Referring now to drawing FIG. 7, yet still another embodiment of the present invention provides a complete configuration of one end sections of a rope belt 40 comprising one thin belt 20 with a rectangular cross section and an oval opening 35 at the first end of the belt. The buckle 11 has two matching slits 15 to receive the belt. As such, by threading the belt through the two slits 15 on buckle 11, allowing the oval opening to be exposed to receive the second end of the belt to complete the configuration of rope belt 40. Here, the belt 40 can be a leather strand/belt or fabric made of cotton or any other material.

The belt, according to the present invention, is formed of only two or three pieces of material, namely the buckle 11 and one or more rope ropes. The rope belt of the present invention is a belt that is durable in use, dries quickly if it happens to become wet and is dimensionally stable under all conditions of use.

The rope (20 or 25) of the rope belt of the present invention can be of all different kinds. Many different materials can be used for making the rope (made from cotton, paper, synthetic materials, leather and others), band/ribbon (made from cotton, paper, synthetic materials, leather and others), strips of fabric (made from cotton, paper, synthetic materials, leather and others) as well as cable (made from metal, different alloys, of any shape, width, diameter or form). The cross section of the rope can also be of all different kinds, such as, but is not limited to, round, square, triangular, and rectangular, while the plurality of holes on the buckle should have the corresponding size and shape to accommodate the rope of various cross section. The number of ropes used in the present invention can be either a single rope, or multiple ropes that are bunched or joined together. The rope(s) can also have a loop pre-disposed on a second end of the rope, which is formed by folding and affixing this second end of the rope back onto a mid-section of the rope. The affixing can be achieved through the use of a variety of methods, including, but not limited to, tying a knot or splicing in the rope. Such knot-tying, splicing and/or other techniques to create a loop are well known to a person of ordinary skill in the art. The rope can be commercially available, or in certain situations, such as in an emergency, any materials at hand can be utilized, as needed.

Figure 5A:
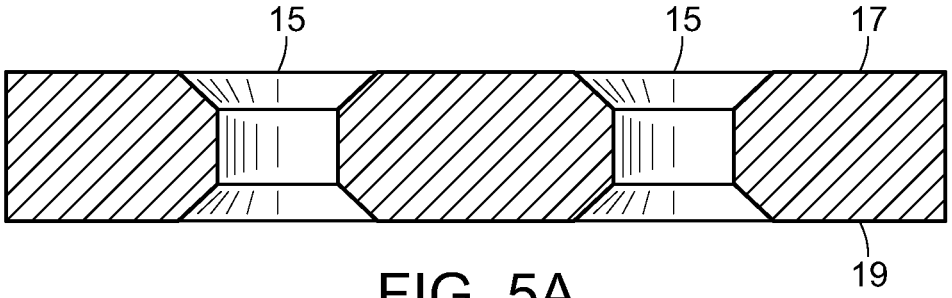
FIG. 5A shows a sectional view of an embodiment of the invention of the buckle.
Figure 5B:
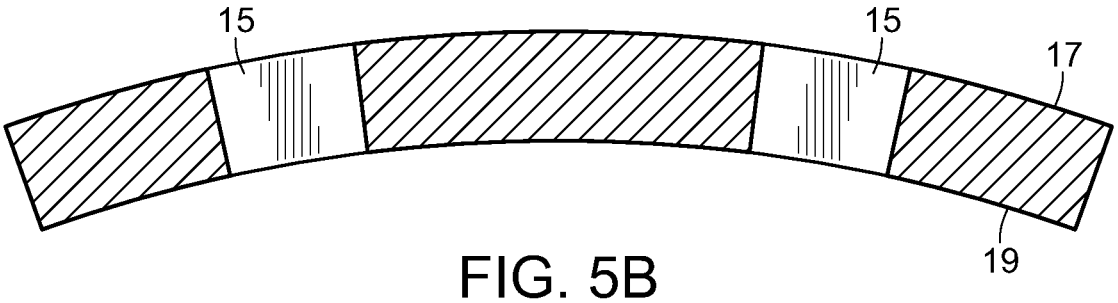
FIG. 5B shows a sectional view of an embodiment of the invention of the buckle.

The buckle 11 can be made of any dense materials, including, but not limited to wood, plastic, metal, alloys, and other materials. The shape and size of buckle 11 can be of, but is not limited to, any geometric shape or form (such as, circle, oval, square, and others) or a non-geometric shape or form (such as figures, silhouettes, faces, tools, shapes that do not necessarily form a simple geometric shape) and an irregular shape. As shown in FIG. 5, the buckle can be either flat (as shown in FIG. 5A), or curved (as shown in FIG. 5B), at different angles and/or radii. When the buckle is curved, at different angles and/or radii, the holes are in the shape of a curved trapezoid (or an annular fraction).

The shape of the buckle 11 can be of a specific shape for a specific application. For instance, in one of the preferred embodiments, the buckle 11 is made in a rectangular-shaped of considerable strength, simplicity, and beauty which is very economical to manufacture and extremely durable and useful in various operation. In an emergency situation where a lifeline is needed, the belt can be removed from the trousers of the wearer and retrieved from the holes on the buckle. This entire unraveling operation can be completed in a matter of seconds to provide, almost instantly, a lifeline for emergency situations. After the emergency situation has been resolved, the rope may be rethread back into the holes on the buckle 11 again to resume its function as a belt. Further, multiple buckles can be used in conjunction with any number of ropes. This may add a decorative element or add an additional functional element to the belt. In some embodiments, one may utilize between two and ten buckles on an given number of belts (ropes).

Holes/openings in the buckle can be of various geometric figures (e.g., round, oval, square, rectangular, triangular, as well as in form of rhombuses, trapezoids, stars with different colliery rays, gears) and/or arbitrary forms. In other words, holes can be for a specific purpose, not of just a particular geometric shape.

The holes/opening in the buckle can be modified or unmodified. The holes/openings can be chamfered, beveled, demurred, or have a raised edge surrounding the hole. The holes/openings can be beveled/chamfered/demurred/raise-edged at different angles from 1 degree to 89 degrees (see FIG. 5).

Other applications of the rope belt of the present invention also include the uses of the strong rope, heavy buckle or their combinations as a self-defense/self-protection weapon, a means to carry large/heavy loads, and other various applications in travel and everyday life.

The many elements of the present invention make it unique in the field. The creativity is illustrated by the various options for nearly every aspect of the invention that allow it to be used in the proper exercise form by a variety of users, both in terms of body size and fitness level. Additionally, there is a wide range of exercises available to any user of the present invention, and users can perform exercises that use the upper and lower extremity muscle groups simultaneously.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A clothing belt comprising:

a buckle having a top surface, a bottom surface, a thickness, and a plurality of holes, wherein at least one of the plurality of holes has a beveled opening at either of the top surface or the bottom surface of the buckle; and at least one length of rope, the length of rope having a first end and a loop, wherein the first end is configured to pass through at least two of the plurality of holes of the buckle and the loop has an opening sized to allow the buckle to be passed through the opening, wherein the at least one length of rope is configured to frictionably engage the buckle such that the buckle is selectively retained at a point along a length of the at least one length of rope to enable the adjustment of a length of the clothing belt.

2. The clothing belt of claim 1, wherein said plurality of holes have sizes and shapes to accommodate the rope.

3. The clothing belt of claim 1, wherein said plurality of holes have a bevel from 1 degree to 89 degrees.

4. The clothing belt of claim 1, wherein said loop is disposed on a second end of the length of rope and is formed by folding and affixing the second end of the rope back onto a mid-section of the rope.

5. The clothing belt of claim 1, wherein said loop is formed by threading the second end of the rope into at least one of the plurality of holes on the buckle.

6. The clothing belt of claim 1, wherein the plurality of holes comprise from 2 to 16 holes.

7. The clothing belt of claim 1, wherein the plurality of holes on said buckle are arranged in various configurations used for various threading patterns.

8. The clothing belt of claim 1, wherein a plurality of ropes are bunched or joined together passing through the plurality of holes on the buckle and forming one loop.

9. The clothing belt of claim 1, wherein there are a plurality of ropes that act independently by passing independently through the plurality of holes on the buckle and forming independent loops that can be bunched into one loop.

10. A clothing belt comprising:

a buckle having, a top surface, a bottom surface, a thickness, and a plurality of holes arranged in at least two rows, wherein at least one of the plurality of holes has a beveled opening at either of the top surface or the bottom surface of the buckle;

a first rope having a first end passing through at least one hole in a first row of holes and a second end passing through at least one hole in a second row of holes, thus forming a loop for hooking onto the buckle; and a second rope having a first end passing through at least one hole in the first row of holes and a second end passing through at least one hole in the second row of holes to form a loop for hooking onto the buckle;

wherein each of the first rope and the second rope frictionably engages the plurality of holes such that the buckle is selectively held at a position on the first rope and the second rope.

11. The clothing belt rope belt of claim 10, wherein said plurality of holes have sizes and shapes to accommodate the first rope and the second rope.

12. The clothing belt of claim 10, wherein said plurality of holes have a bevel from 1 degree to 89 degrees.

13. The clothing belt of claim 10, wherein said plurality of holes comprises from 4 to 16 holes.

14. The clothing belt of claim 10, wherein said plurality of holes are arranged in at least two rows of 4 holes.

15. A method of forming a clothing belt to secure a garment on a desired body position of a user, and said method comprising the steps of:

passing a first end of at least one rope through at least two holes of a plurality of holes on a buckle;

wrapping a second end of the at least one rope back onto a mid-section of the at least one rope to form a loop;

adjusting a length of the clothing belt by moving the buckle to a position on the at least one rope, wherein the buckle is held at the position via a friction fit between the at least one rope and the plurality of holes on the buckle; and hooking the loop of the at least one rope around the buckle to secure the clothing belt.

16. The method of claim 15 further comprising the step of:

passing the second end of the at least one rope through at least two holes of the plurality of holes on the buckle.

* * * * *